US006393615B1

(12) United States Patent
Bedell

(10) Patent No.: US 6,393,615 B1
(45) Date of Patent: May 28, 2002

(54) CHALLENGER GLOVE FOR HOLDING OBJECTS

(76) Inventor: Archie W. Bedell, 5540 Section Rd., Ottawa Lake, MI (US) 49267

( * ) Notice: Subject to any disclaimer, the term of this patent is extended or adjusted under 35 U.S.C. 154(b) by 0 days.

(21) Appl. No.: 09/779,804

(22) Filed: Feb. 8, 2001

(51) Int. Cl.[7] ..... A41D 19/00
(52) U.S. Cl. ..... 2/161.1; 2/159
(58) Field of Search ..... 2/161.1, 161.2, 2/161.6, 159, 917

(56) References Cited

U.S. PATENT DOCUMENTS

| | | | | |
|---|---|---|---|---|
| 617,755 | A | | 1/1899 | Martin |
| 2,083,604 | A | * | 6/1937 | Hay |
| 2,751,598 | A | * | 6/1956 | Romeo |
| 2,852,779 | A | * | 9/1958 | Roessler |
| 3,105,972 | A | * | 10/1963 | Christopher |
| 3,348,238 | A | * | 10/1967 | Hydock |
| 3,408,657 | A | | 11/1968 | Gallagher |
| 3,559,212 | A | | 2/1971 | Skovron ..... 2/161 |
| 3,774,242 | A | * | 11/1973 | Owen |
| 3,918,097 | A | * | 11/1975 | Mlodoch |
| 4,447,912 | A | * | 5/1984 | Morrow |
| 4,698,850 | A | | 10/1987 | Patton, Sr. et al. ..... 2/159 |
| 4,815,147 | A | * | 3/1989 | Gazzano et al. |
| 5,022,094 | A | * | 6/1991 | Hames et al. |
| 5,033,120 | A | | 7/1991 | Myers ..... 2/161 A |
| 5,088,122 | A | * | 2/1992 | O'Toole |
| 5,217,029 | A | * | 6/1993 | Shields |
| 5,353,440 | A | * | 10/1994 | Meldeau |
| 5,435,013 | A | * | 7/1995 | Davis |
| 5,557,805 | A | | 9/1996 | Emerson ..... 2/158 |
| 5,846,168 | A | | 12/1998 | Murray ..... 482/105 |
| 6,035,442 | A | * | 3/2000 | Marando |
| 6,073,269 | A | * | 6/2000 | Diaco |

FOREIGN PATENT DOCUMENTS

| | | | |
|---|---|---|---|
| JP | 406079029 | * | 3/1994 |

* cited by examiner

*Primary Examiner*—Rodney M. Lindsey
(74) *Attorney, Agent, or Firm*—Marshall, Gerstein, & Borun

(57) ABSTRACT

A glove for securing an object in a hand of a user includes a wrist portion, palm portion and an opposite dorsal portion. A thumb sleeve and first, second, third and fourth sleeves extend from the palm and dorsal portions. A clasp is attached to the dorsal portion. A strap has one end connected to at least one of the finger sleeves, and a free second end extending outwardly away from the glove. Hook and loop fastening elements are provided on the strap, wherein the strap free second end extends around the object and through the clasp to enable the engagement of the hook and loop fastening elements to secure the object against the glove palm portion. In an alternate embodiment, the strap may be secured to the dorsal portion only using hook and loop fastening elements.

6 Claims, 3 Drawing Sheets

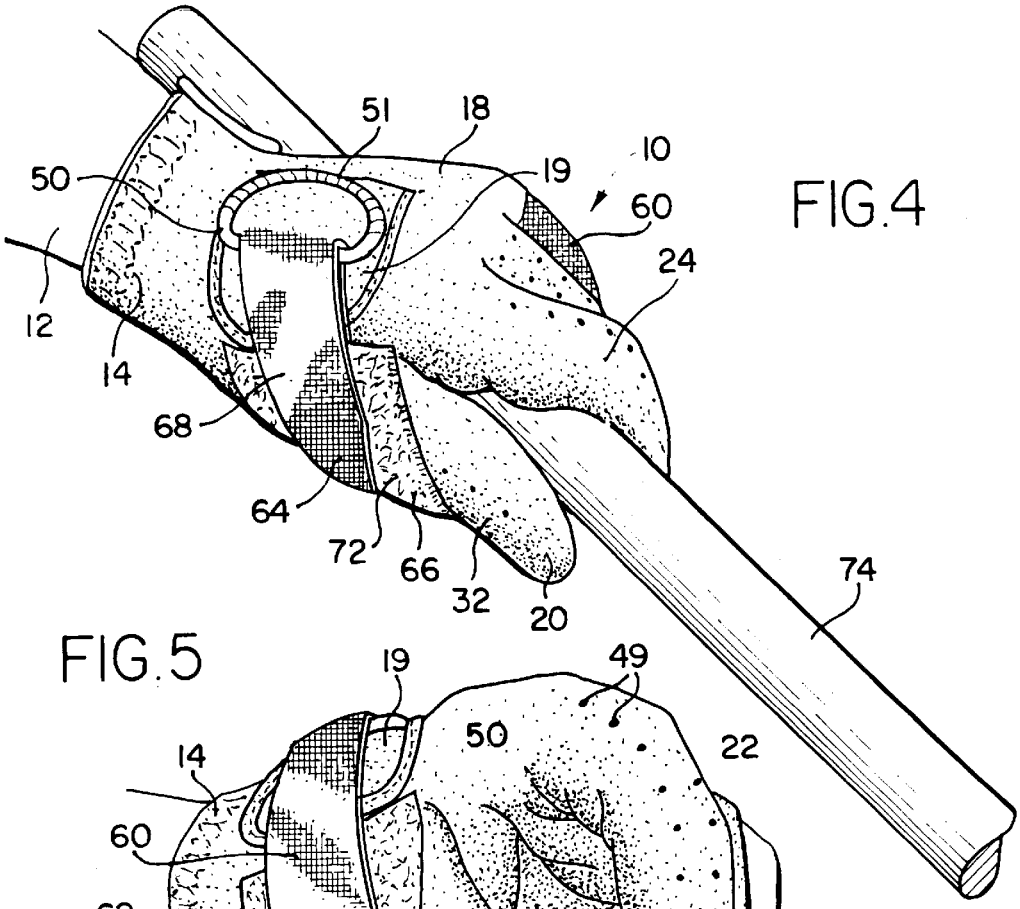
FIG.4
FIG.5
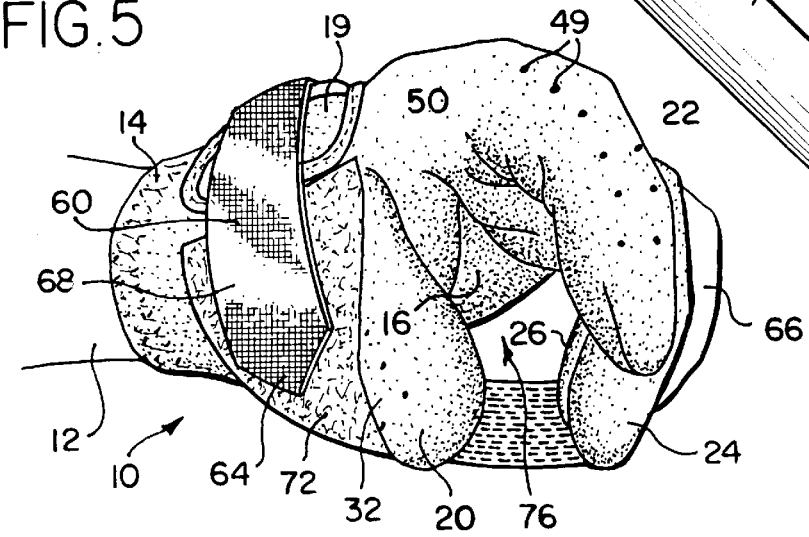
FIG.6
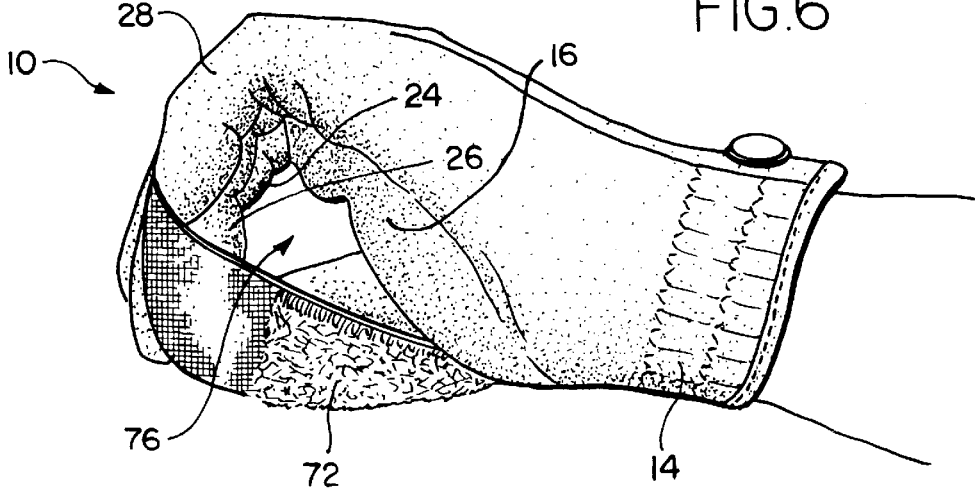

100
112
114
104
102
120
118
116
106
"c"

100
114
108
104
106
112
"c"
21
120
122
116
118

CHALLENGER GLOVE FOR HOLDING OBJECTS

BACKGROUND OF THE INVENTION

1. Field of Invention

The invention relates generally to devices for assisting individuals having neural muscular deficiencies in their hands that make it difficult to grasp objects.

2. Description of Related Technology

Individuals with neural muscular deficiencies in their hands often have difficulty securely grasping and holding objects. Because these individuals have a weakened grip, they are unable to perform activities that require holding objects for an extended period of time. For example, these individuals have difficulty eating, raking and playing various sports including tennis, golf, skiing and fishing. Further, these individuals have difficulty professionally because they may not be able to work as efficiently and productively as their co-workers who do not have neural muscular deficiencies.

Because individuals with these hand deficiencies are severely compromised and often prevented from performing many day to day physical activities, devices have been created to aid these individuals when grasping or holding objects. Many of these hand devices are gloves or mittens that have been adapted to help individuals hold objects. While these devices have helped some afflicted individuals hold objects, the existing devices have several disadvantages. First, the gloves are complex and, therefore, difficult to quickly and easily put on and take off. Second, because of the complexity of some of the current and proposed gripping aid devices, the gripping devices are expensive to manufacture. Finally, because many of the existing devices are not anatomically correct, they are not comfortable to wear, do not perform well for an extended period of time, and are not used by the afflicted individuals.

Currently, there are no gloves that are inexpensive, easy to use and ergonomically designed for individuals with neural muscular hand deficiencies. The disadvantages associated with current gripping devices demonstrate that there remains a need for a device to aid individuals for securely grasping or holding objects.

SUMMARY OF THE INVENTION

The present invention consists of a glove for securing an object in a hand of an individual including a strap and a clasp securely maintaining the object against a glove palm portion.

The glove includes a wrist portion that encircle's the user's wrist when the user inserts his hand into the glove. The glove also includes the palm portion extending from the wrist portion on one side of the glove and a dorsal portion extending from the wrist portion on the other side of the glove opposite the palm portion. The glove has a thumb sleeve extending from the palm and dorsal portions as well as finger sleeves extending from the palm and dorsal portions. Each finger sleeve has a palm side and a dorsal side.

The clasp is connected to the dorsal portion, and the strap is connected to at least one of the finger sleeves. The strap has opposite first and second ends as well as a top face and a bottom face. Additionally, the strap has hook and loop fastening elements. The end of the strap, which is not attached to the finger sleeve(s), extends around an object and engages the clasp to enable the hook and loop fastening elements to make contact and secure the strap to the clasp.

When the strap is secured to the clasp, the object is securely held against the palm portion.

An additional embodiment of the glove has one component of hook and loop fastening elements coupled to the dorsal portion and the other of the hook and loop fastening elements coupled to the second end of the strap.

BRIEF DESCRIPTION OF THE DRAWINGS

The many advantages and features of the present invention will be appreciated from the following detailed description of several preferred embodiments with reference to the attached drawings wherein like reference numerals are used to represent like elements, and in which:

FIG. 4 is a perspective view of the glove with the strap secured to the clasp for holding an object in the palm portion of the glove;

FIG. 5 is a perspective view of the glove showing the thumb sleeve and the first finger sleeve when the strap is secured to the clasp;

FIG. 6 is a perspective view of the glove showing the fourth finger sleeve when the strap is secured to the clasp;

DESCRIPTION OF THE PREFERRED EMBODIMENTS

Figure 1:
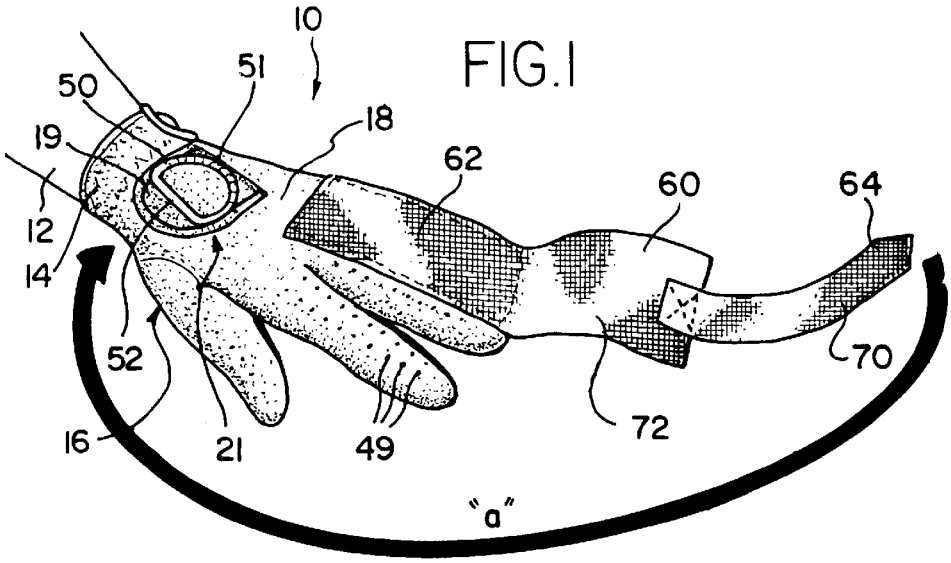
FIG. 1 is a perspective view of a glove having a strap that has respective hook and loop fastening elements and is attached to a dorsal side of at least one finger sleeve for assisting to grasp objects in accordance with the present invention.

Referring generally to FIGS. 1–6, a glove 10 for assisting an individual 12 having muscular neural deficiencies includes a wrist portion 14 that encircles the individual's wrist upon the individual's hand being inserted into the glove 10, palm portion 16 for covering the palm of the individual's hand, and a dorsal portion 18 for covering the back side of the individual's hand. The palm portion 16 includes a fastening mechanism with a flap 19, including hook and loop fastening elements 21, to securely fit the glove 10 on the individual's hand.

In a preferred embodiment, the glove 10 also includes a thumb sleeve 20 for covering the thumb of the individual 12, a first finger sleeve 22, a second finger sleeve 24, a third finger sleeve 26, and fourth finger sleeve 28 for covering the fingers of the individual 12. The thumb sleeve 20 and each finger sleeve 22, 24, 26, 28 extend from the palm portion 16 and the dorsal portion 18 of the glove 10 to completely cover the individual's hand. Further, the thumb sleeve 20 has a palm side 30 and a dorsal side 32. Similarly, the first finger sleeves 22, 24, 26, 28 each have a palm side and a dorsal side. In an alternative form, the glove 10 may have fewer than four finger sleeves thereby covering at least one but not all of the individual's fingers. This alternate form, having fewer than four finger sleeves, may be cooler in warm environments and may give the individual more freedom to move some of his fingers.

In a preferred embodiment of the glove 10, the wrist portion 14, the palm portion 16, the dorsal portion 18, the thumb sleeve 20 and the finger sleeves 22, 24, 26, 28 are made of a durable, flexible material, such as leather. The glove 10 may also include small openings 49 in the material to allow the hand to breathe. Other embodiments of the glove 10 may be made of cloth or any other material possessing similar properties. The size of the various components of the glove may vary to conform with usual standards of fit.

As shown in FIG. 1, the glove 10 has a clasp 50. The clasp 50 is attached to the fastening flap 19 which is attached to the dorsal portion 18. The clasp 50 may be attached with glue or strong thread or any other method of attachment known to those skilled in the art. In an alternate form of the invention, the clasp 50 may be directly attached to the dorsal portion 18. In a preferred embodiment, the clasp 50 is a metallic ring. The ring has a curved portion 51 which is connected to the flap 19 and a flat portion 52 which may be engaged by a strap 60 as described below. In alternate embodiments of the glove 10, the clasp 50 may be made of another material, such as plastic, and may take any other shape.

The glove 10 also includes a strap 60 for assisting to securely grasp objects in accordance with this invention. The strap 60 has a first end 62 opposite a second end 64. The strap 60 further includes a top face 66 and a bottom face 68. As shown in FIG. 1, the bottom face 68 of the first end 62 is connected to the dorsal side of the second finger sleeve 24, the dorsal side of the third finger sleeve 26, and the dorsal side of the of the fourth finger sleeve 28. The second end 64, which is not connected to the glove 10, extends away from the glove 10 when it is not in use. The strap 60 also includes hook fastening elements 70 and loop fastening elements 72 for securing the strap 60 to the clasp 50. In a preferred embodiment, the hook fastening elements 70 are located on the top face 62 on the second end 64 of the strap 60. The loop fastening elements 72 are intermediately located on the top face 66 of the strap 60 between the first end 62 and the second end 64. In a preferred embodiment, the strap is made of a flexible, durable material, such as leather or a woven nylon fabric. However, in alternative embodiments, the strap may be any material possessing similar qualities.

Figure 2:
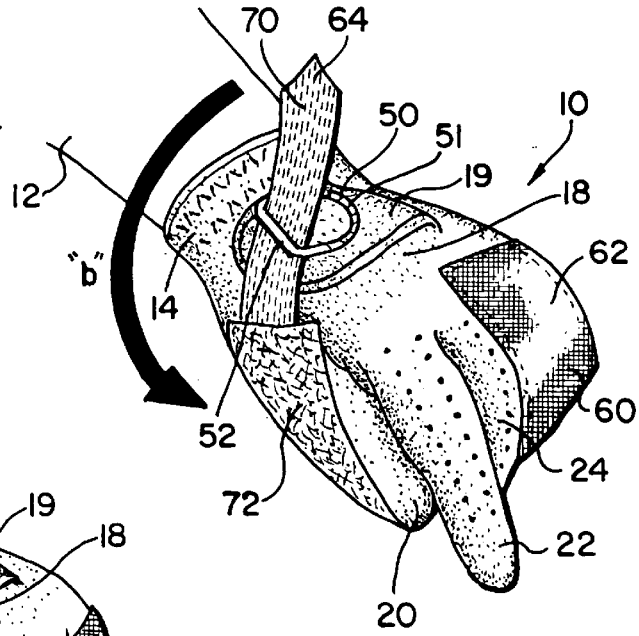
FIG. 2 is a perspective view of the glove with the strap engaging a clasp on the dorsal side of the glove.

When the glove 10 has been securely fitted on the individual's hand, the second end 64 of the strap 60 is pulled in the direction of the clasp 50 shown as direction arrow "a." As shown in FIG. 2, the second end 64 is pulled through the ring-shaped clasp 50. The strap 60 engages the flat portion 52 of the clasp 50. This movement of the strap 60 causes the second 24, third 26 and fourth 28 finger sleeves to be pulled into a fist-like position. Because the first finger sleeve 22 is not connected to the strap 60, the individual is free to adjust his grip using the first finger. As is shown, the strap 60 engages the dorsal side 32 of the thumb sleeve 20 as the strap 60 is pulled across the finger sleeves to engage the clasp 50. When the strap 60 is pulled across the finger sleeves 24, 26, 28 and the thumb sleeve 20, the user's grip is reinforced or strengthened by the strap 60. This allows the user to better grasp objects for an extended period of time. Additionally, by fastening the strap 60 securely to the clasp 50, individuals wearing the glove can pick up and grip heavy objects because of the clasp 50 provides a high degree of resistance. An individual wearing the glove will not drop such heavy objects because his grip will not loosen until he decides to disengage the strap 60 from the clasp 50. Direction arrow "b" shows the direction in which the second end 64 is pulled after it passes beneath the flat portion 52 of the clasp 50 and then over the flat portion 52. In alternate embodiments the second end 64 may pass over the flat portion 52, through the clasp and then under the flat portion 52.

Figure 3:
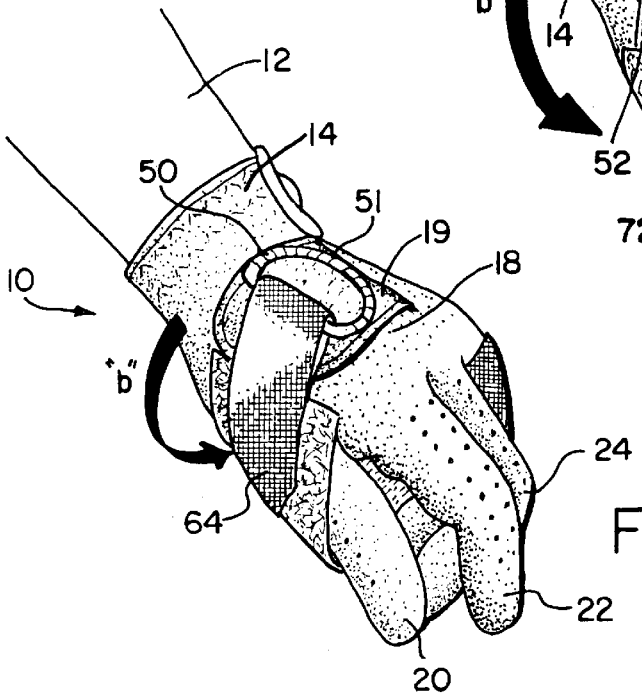
FIG. 3 is a perspective view of the glove with the strap engaging the clasp for enabling engagement of the hook and loop fastening elements on the strap.

As shown in FIG. 3, the second end 64 is wrapped around the clasp to allow the hook fastening elements 70 to make contact with the loop fastening elements 72 for securing the strap 60 to the clasp 50. The top face 66 of the second end 64 is folded over the flat portion 52 of the clasp 50 so that the loop fastening elements 72 may engage the hook fastening elements 70 located on the top face 62. When the strap 60 is securely in place, the user's fingers and thumb are forcibly held in a gripping position to grasp objects. The loop fastening elements 72 on the second end 64 of the strap 60 may be adjustably positioned on the hook fastening elements 70 to allow the user the vary the size of the grip depending upon the size of the object to be held.

When the glove 10 securely fitted to the user's hand and the strap 60 is engaged with the clasp 50 on the dorsal side of the glove 10, the glove 10 is positioned to provide the maximum support to assist the user to grasp objects, such as the illustrated object 74. The attachment of the strap 60 to the dorsal portion 18 or dorsal side of the glove 10 helps control the gripping power of the thumb as well as the fingers. Furthermore, the glove 10 is ergonomically designed for a comfortable fit while still enhancing the strength the user's grip. By wrapping the strap 60 around the fingers and the thumb and connecting the strap 60 to the dorsal side of the glove 10, the hand is maintained in a very natural and comfortable position for the user.

FIG. 4 shows an individual wearing the glove 10 with the strap 60 secured to the clasp 50 and holding an object 74 in the palm of his hand. The object 74 is held in the palm portion 16 of the glove 10 and the finger sleeves 22, 24, 26 28 are wrapped around the object 74. FIG. 4 illustrates one position of the first finger sleeve 22 and the thumb sleeve 20 on the object 74. As previously mentioned, the hand will be held in this position until the strap 60 is disengaged from the clasp 50.

FIG. 5 shows the position of the thumb sleeve 20 and the first finger sleeve 22 when the strap 60 is secured to the clasp 50 by the hook fastening elements 70 and the loop fastening elements 72. As is shown, the fingers and thumb are held in a position creating a passageway 76 defined by the palm portion 16, the palm portions of the finger sleeves, the thumb sleeve and the strap 60 in which the object, such as object 74, is cradled while the glove is in use. FIG. 6 illustrates the positioning of the fourth finger sleeve 28 when the strap 60 is secured to the clasp 50. As is shown, the strap 60, when secured to the clasp 50, covers the finger sleeves 24, 26, 28, traverses the palm portion 16 and wraps around the thumb sleeve 20.

In alternate embodiments of the glove 10, the strap 60 may be connected to the dorsal sides of different combinations of the finger sleeves, including, but not limited to, the third 26 and fourth 28 finger sleeves; the second 24 and fourth 28 finger sleeves; and the first 22, second 24, third 26 and fourth 28 finger sleeves. Additionally, alternate embodiments of the glove 10 may attach the first end 62 of the strap 60 to the palm side of any finger sleeve or a combination of finger sleeves.

Further alternate embodiments may vary the location of the hook and loop fastening elements. For example, the hook fastening elements 70 may be intermediately located on the top face 66 between the first end 62 and the second end 64 and the loop fastening elements may be located on the top face 66 of the second end 64 of the strap 60. Additionally, alternate embodiments of the glove 10 may utilize a different mechanism to secure the strap 60 to the clasp 50, such as a snap or a buckle.

Figure 7:
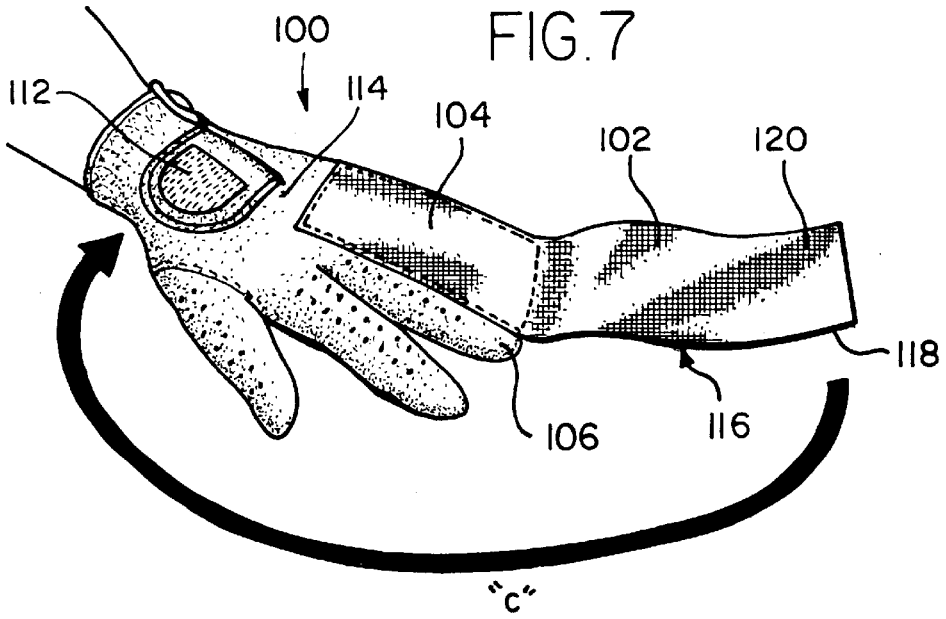
FIG. 7 is a perspective view of a glove having a dorsal portion which has one component of a hook and loop fastening elements and a strap which has the other component of hook and loop fastening elements and is attached to the dorsal side of a least one finger sleeve.
Figure 8:
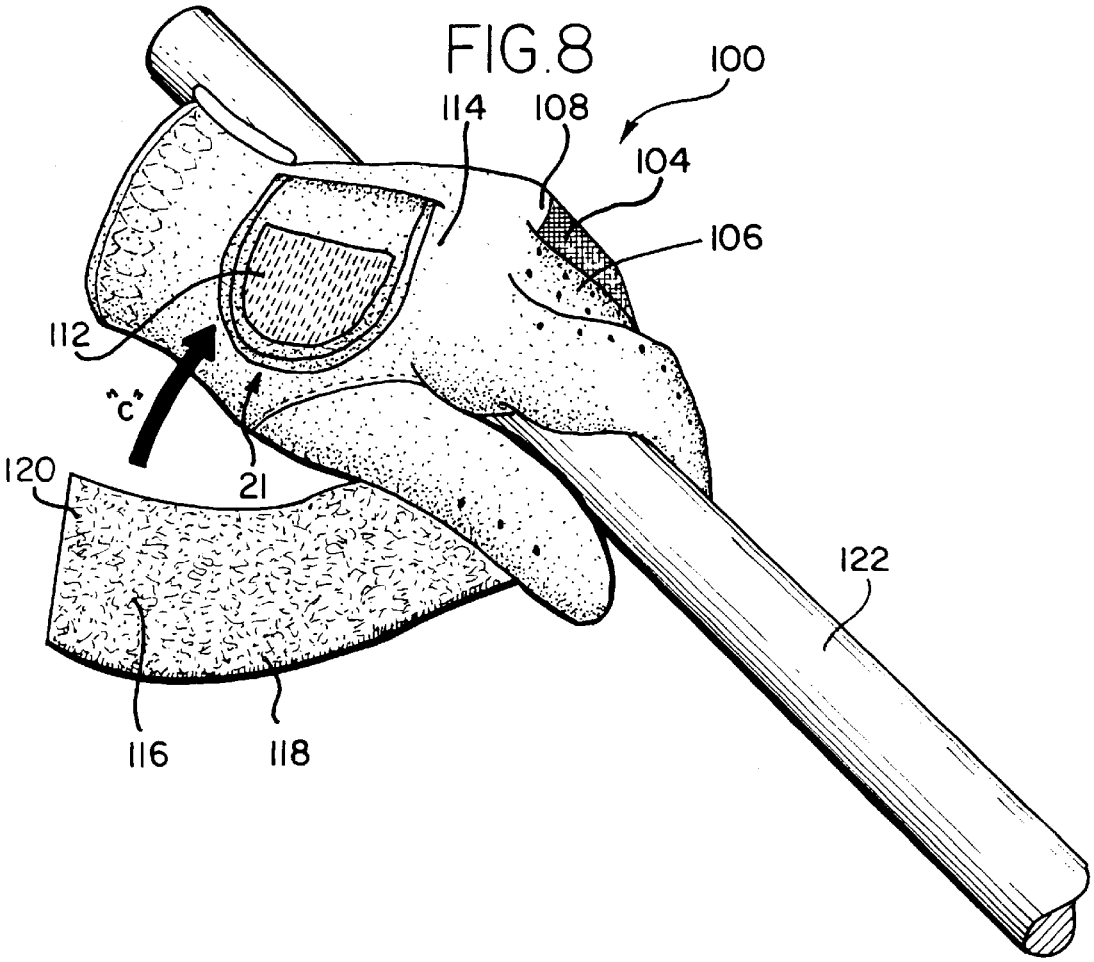
FIG. 8 is a perspective view of the glove of FIG. 7 with the strap wrapped around the finger sleeves for engagement with the dorsal portion of the glove.

FIGS. 7 and 8 show an alternate embodiment of the glove 100 having only one of the hook and loop fastening elements attached to the strap 102. The first end 104 of the strap 102 is attached to the dorsal sides of the second finger sleeve 106, the third finger sleeve 108 and the fourth finger sleeve 110 but may be attached to any one or a combination of the finger sleeves. The hook fastening elements 112 are coupled to the dorsal portion 114 of the glove 100. As shown in FIG. 8, the loop fastening elements 116 are attached to the bottom face 118 of the second end 120 of the strap 102. The second end 120 must be moved as indicated by direction arrow "c" to enable the hook and loop fastening elements to make contact. When the second end 120 is secured to the dorsal portion 114, an object 122 can be gripped by the user. In other embodiments, the hook fastening elements 112 may be located on the strap 102 and the loop fastening elements 116 may be coupled to the dorsal portion 114. This alternate embodiment of the glove 100 allows the user to quickly and easily secure the strap 102 to the back side of the glove 100 which is particularly useful for individuals with very debilitating neural muscular problems. Additionally, this embodiment of the glove 100 may help individuals pick up and grip light objects and provides less resistance than the aforementioned clasp 50 and strap 60 fastening mechanism which is, therefore, better for holding lighter objects.

The invention has been described in terms of several preferred embodiments. The description of these embodiments should in no way be considered limiting of the broad scope of the invention set forth in the following claims.

I claim:

1. A glove for securing an object in a hand of a user, the glove comprising:

a wrist portion for encircling the user's wrist upon the user's hand being inserted into the glove;

a palm portion extending from the wrist portion on one side of the glove;

a dorsal portion extending from the wrist portion on the other side of the glove opposite the palm portion, the dorsal portion and palm portion together adapted to encircle the user's hand;

a thumb sleeve extending from the palm portion and the dorsal portion;

a first finger sleeve, a second finger sleeve, a third finger sleeve, and a fourth finger sleeve, each respectively extending from the palm portion and the dorsal portion and including a palm side and a dorsal side;

a clasp attached to the dorsal portion; and a strap having opposite first and second ends and respective hook and loop fastening elements, the first end integrally connected to the dorsal portion and to at least two of the finger sleeves and extending integrally, coextensively therewith, the second end for extending around the object and engaging the clasp to enable engagement of the respective hook and loop fastening elements to secure the strap to the clasp with the object securely held against the palm portion.

2. The glove of claim 1, wherein the loop fastening elements are intermediately located between the first and second ends of the strap and the hook fastening elements are located on the second end of the strap.

3. The glove of claim 1, wherein the strap includes a top face and a bottom face, the bottom face integrally connected to the dorsal portion and the dorsal side of at least two finger sleeves extending integrally, coextensively therewith, and the top face having the hook and loop fastening elements.

4. The glove of claim 1, wherein the first finger sleeve is adjacent the thumb sleeve, the second finger sleeve is adjacent the first finger sleeve, the third finger sleeve is adjacent the second finger sleeve and the fourth finger sleeve is adjacent the third finger sleeve, wherein the first end is integrally connected to the dorsal portion and the dorsal side of the second, third and fourth finger sleeves.

5. The glove of claim 1, further including a passageway defined by the palm portion, the palm sides of the finger sleeves, the thumb sleeve and the strap.

6. A glove for securing an object in a hand of a user, the glove comprising:

a wrist portion for encircling the user's wrist upon the user's hand being inserted into the glove;

a palm portion extending from the wrist portion on one side of the glove;

a dorsal portion extending from the wrist portion on the other side of the glove opposite the palm portion, the dorsal portion and palm portion together adapted to encircle the user's hand;

a thumb sleeve extending from the palm portion and the dorsal portion;

a first finger sleeve, a second finger sleeve, a third finger sleeve, and a fourth finger sleeve, each respectively extending from the palm portion and the dorsal portion and including a palm side and a dorsal side;

hook and loop fastening elements; and a strap having opposite first and second ends; wherein one component of the hook and loop fastening elements is coupled to the dorsal portion, the first end is integrally connected to the dorsal portion and to each dorsal side of the second finger sleeve, the third finger sleeve, and the fourth finger sleeve and extending integrally, coextensively therewith, the second end has the other component of the hook and loop fastening elements and extends around the object to enable engagement of the respective hook and loop fastening elements to secure the strap to the dorsal portion with the object securely held against the palm portion.

* * * * *